US009819128B2

(12) United States Patent
Zhou et al.

(10) Patent No.: US 9,819,128 B2
(45) Date of Patent: Nov. 14, 2017

(54) CABLE CONNECTOR HAVING AN OUTER CASING WITH A LIGHT TRANSMISSIVE REGION AND A GROOVED METALLIC SHELL ACCOMMODATING A LIGHT EMITTING ELEMENT

(71) Applicant: FOXCONN INTERCONNECT TECHNOLOGY LIMITED, Grand Cayman (KY)

(72) Inventors: Zhi-Yong Zhou, Kunshan (CN); Xiao Fan, Kunshan (CN); Jun Chen, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/157,434

(22) Filed: May 18, 2016

(65) Prior Publication Data

US 2016/0344145 A1 Nov. 24, 2016

(30) Foreign Application Priority Data

May 18, 2015 (CN) ..... 2015 1 0251469

(51) Int. Cl.
*H01R 3/00* (2006.01)
*H01R 13/717* (2006.01)
(Continued)

(52) U.S. Cl.
CPC ..... *H01R 13/7175* (2013.01); *H01R 13/6658* (2013.01); *H01R 13/7172* (2013.01);
(Continued)

(58) Field of Classification Search
CPC .. H01R 13/71; H01R 13/717; H01R 13/7172; H01R 13/7175; H01R 13/6581; H01R 13/648
(Continued)

(56) References Cited

U.S. PATENT DOCUMENTS 7,758,373 B2 * 7/2010 Zhou ..... H01R 13/562 439/455
7,914,320 B2 * 3/2011 Ko ..... H01R 13/502 439/490
(Continued)

FOREIGN PATENT DOCUMENTS

CN 102761035 A 10/2012

*Primary Examiner* — Chandrika Prasad
(74) *Attorney, Agent, or Firm* — Wei Te Chung; Ming Chieh Chang

(57) ABSTRACT

A cable connector assembly comprises a cable and an electrical connector electrically connected with the cable, the electrical connector includes a mating member, a PCB connected with the mating member, a metal shell enclosing the PCB, and an outer case covering the metal shell, the PCB includes a front end, a rear end and a middle portion connecting with the front end and the rear end; wherein the light emitting element is mounted on the middle portion of the PCB, the metal shell includes a front portion, a rear portion, and a connecting portion connecting the front portion and the rear portion, the connecting portion defines a groove, a distance between a bottom of the groove and the PCB is equal to or smaller than a height of the light emitting element, and the outer case has a light-transmissive portion to pass light emitted by the light emitting element.

9 Claims, 10 Drawing Sheets

(51) Int. Cl.

| | |
|---|---|
| ***H01R 13/66*** | (2006.01) |
| *H01R 13/6581* | (2011.01) |
| *H01R 107/00* | (2006.01) |
| *H01R 24/60* | (2011.01) |

(52) U.S. Cl.
CPC ..... *H01R 13/6581* (2013.01); *H01R 24/60* (2013.01); *H01R 2107/00* (2013.01)

(58) Field of Classification Search
USPC ..... 439/490, 607.01
See application file for complete search history.

(56) References Cited

U.S. PATENT DOCUMENTS

| | | | | |
|---|---|---|---|---|
| 8,011,935 | B2 * | 9/2011 | Ko | H01R 13/5845 439/490 |
| 8,535,088 | B2 * | 9/2013 | Gao | H01R 9/03 439/39 |
| 9,028,122 | B2 * | 5/2015 | Tuchrelo | H01R 13/7175 362/253 |
| 2012/0040554 | A1 * | 2/2012 | Ko | H01R 13/641 439/490 |
| 2012/0164875 | A1 * | 6/2012 | Su | H01R 13/7175 439/490 |
| 2013/0308304 | A1 | 11/2013 | Tuchrelo et al. | |

* cited by examiner

CABLE CONNECTOR HAVING AN OUTER CASING WITH A LIGHT TRANSMISSIVE REGION AND A GROOVED METALLIC SHELL ACCOMMODATING A LIGHT EMITTING ELEMENT

BACKGROUND OF THE INVENTION

1. Field of the Invention

The present invention relates generally to a cable connector assembly and more particularly to an improved light emitting diode (LED) related structure thereof.

2. Description of Related Arts

China Patent Application Publication No. 102761035A, published on Oct. 31, 2012, shows a cable connector assembly including a printed circuit board (PCB), an LED mounted on the PCB, a light pipe disposed on a top side of the LED, and an outer case enclosing the PCB. A protruding portion is defined on a top portion of the LED. The light emitted by the LED passes through the outer case from the protruding portion, to indicate the working conditions of the cable connector assembly.

Although the light guide tube portion projecting to the outer case, to form a light transmission area, however, the light transmission area is too small to be observed easily.

U.S. Patent Application Publication No. 2013/0308304, published on Nov. 21, 2013, shows an electrical connector assembly including a housing, a conductor, an electrical connector, a light emitter, and a light guide. The light guide directs light from the light emitter towards a surface of the connector.

U.S. Pat. No. 8,535,088, issued on Sep. 17, 2013, shows a power cable assembly including a cable plug having a housing. The housing includes an LED exit allowing light from an LED inside the housing to escape and a light pipe for guiding light from the LED.

An improved LED related structure in a cable connector assembly is desired.

SUMMARY OF THE INVENTION

An object of the present invention is to provide an improved LED structure in a cable connector for improving the observed effect and appearance.

To achieve the above-mentioned object, a cable connector assembly comprises: a cable and an electrical connector electrically connected with the cable, the electrical connector including a mating member, a printed circuit board (PCB) electrically connected with the mating member, a metal shell enclosing the PCB, and an outer case covering the metal shell, the PCB including a front end, a rear end opposite to the front end and a middle portion connecting with the front end and the rear end; wherein the light emitting element is mounted on the middle portion of the PCB, the metal shell includes a front portion, a rear portion, and a connecting portion connecting the front portion and the rear portion, the connecting portion defines a groove connecting the front portion and the rear portion, a distance between a bottom of the groove and the PCB is equal to or smaller than a height of the light emitting element, and the outer case has a light-transmissive portion to pass light emitted by the light emitting element.

DETAILED DESCRIPTION OF THE PREFERRED EMBODIMENT

Figure 1:
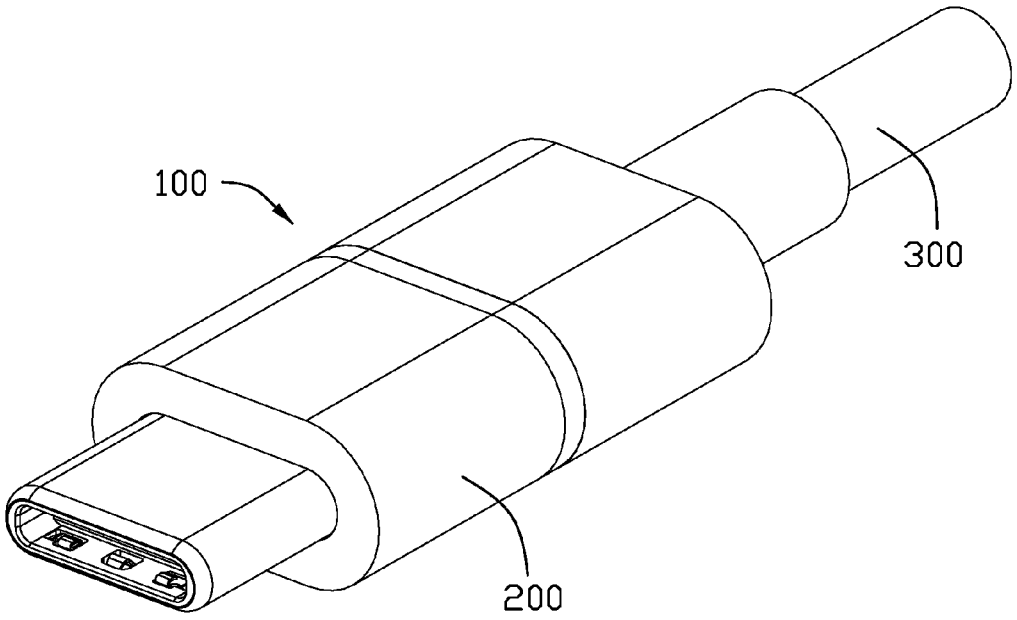
FIG. 1 is a perspective view of a cable connector assembly in accordance with the present invention.
Figure 2:
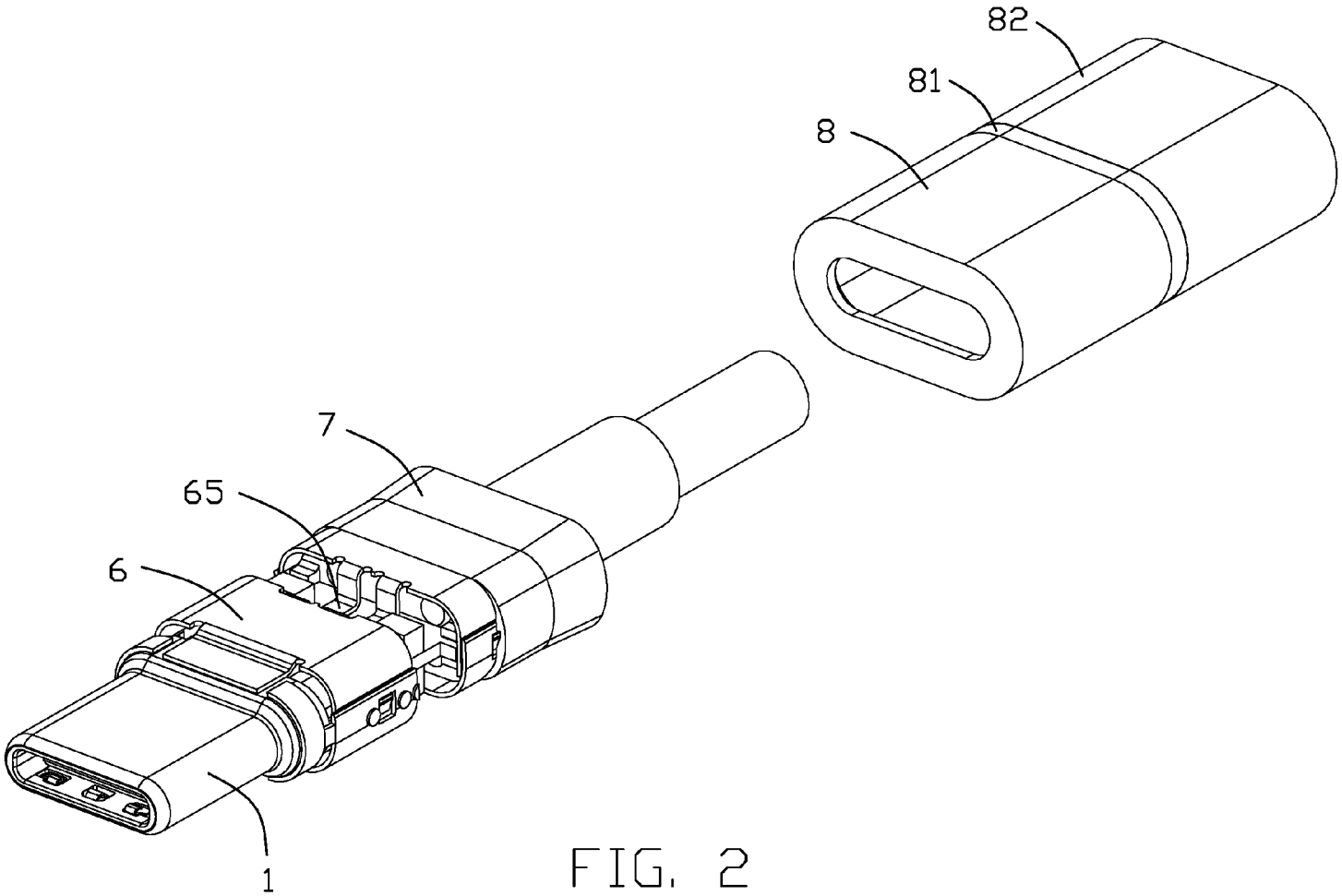
FIG. 2 is a partially exploded view of the cable connector assembly in FIG. 1.
Figure 3:
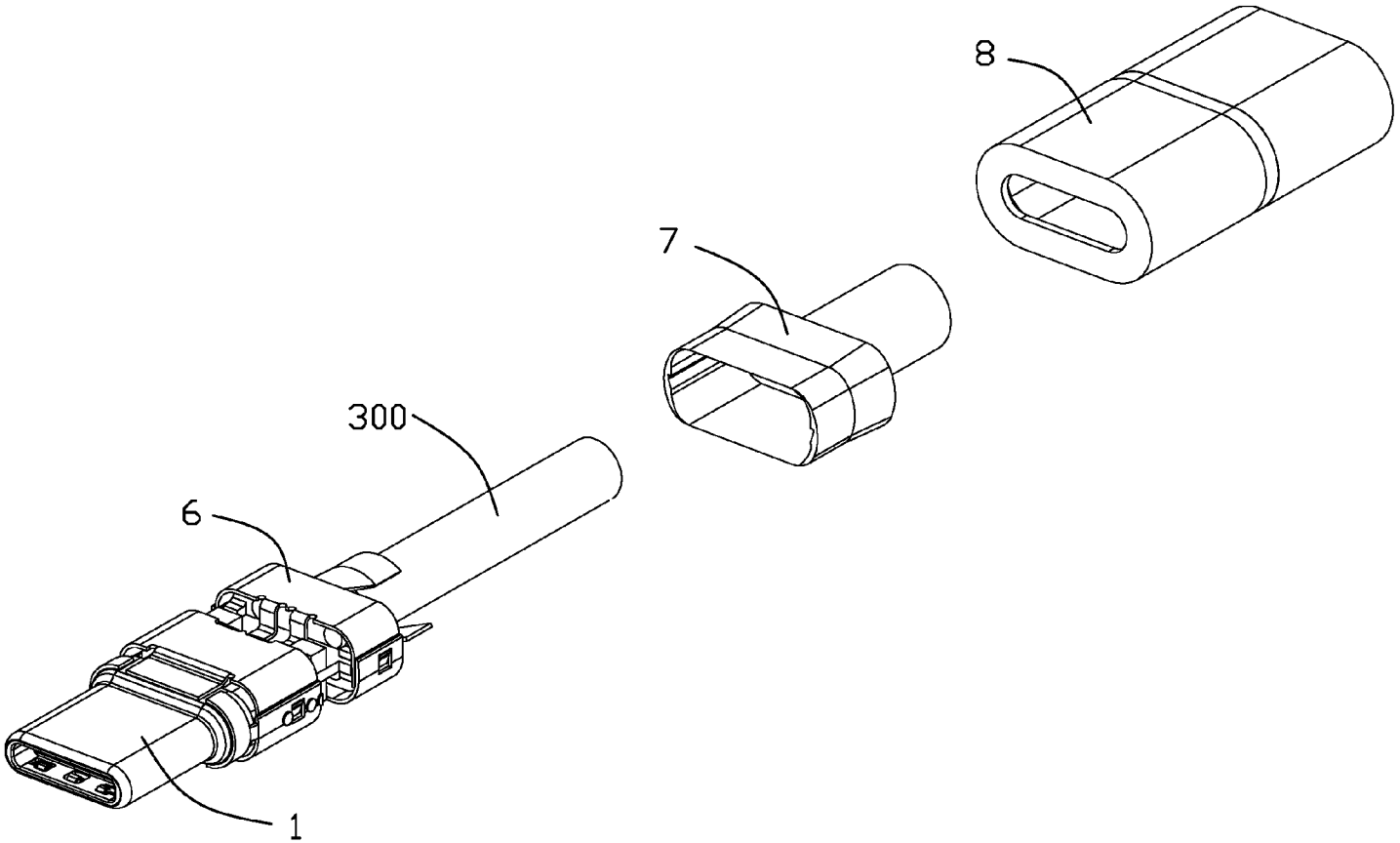
FIG. 3 is a further partially exploded view of the cable connector assembly in FIG. 2.

Referring to FIGS. 1 to 7, a cable connector assembly, e.g., a plug connector assembly 100, in accordance with the present invention for mating with a mating connector (not shown), comprises an electrical connector 200 and a cable 300 electrically connected to the electrical connector 200. The electrical connector 200 includes a mating member 1, a printed circuit board 2 electrically connected with the mating member 1 and disposed along a lateral plane, a plurality of light emitting elements 4 mounted on the printed circuit board 2, a fixing member 5 to fix the cable 300, a metal case 6 enclosing the printed circuit board 2 and a part of cable 300, a strain relief 7 enclosing a part of the metal shell 6, and a metallic covering member or outer case 8 enclosing the metal shell 6 and the strain relief 7. The plug connector assembly 100 can be mated with the mating connector in two orientations.

Figure 8:
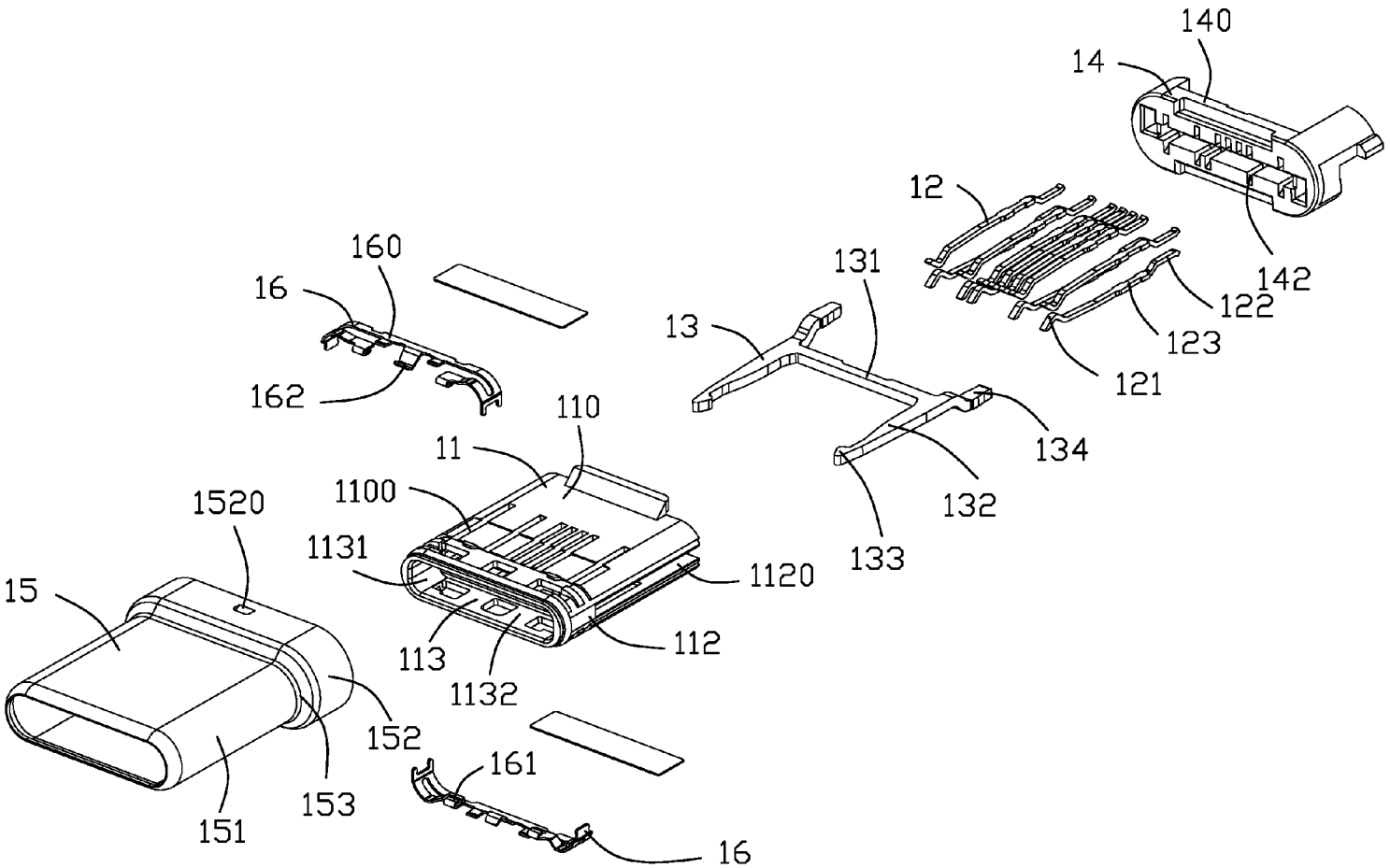
FIG. 8 is an exploded view of the mating member show in FIG. 1.
Figure 9:
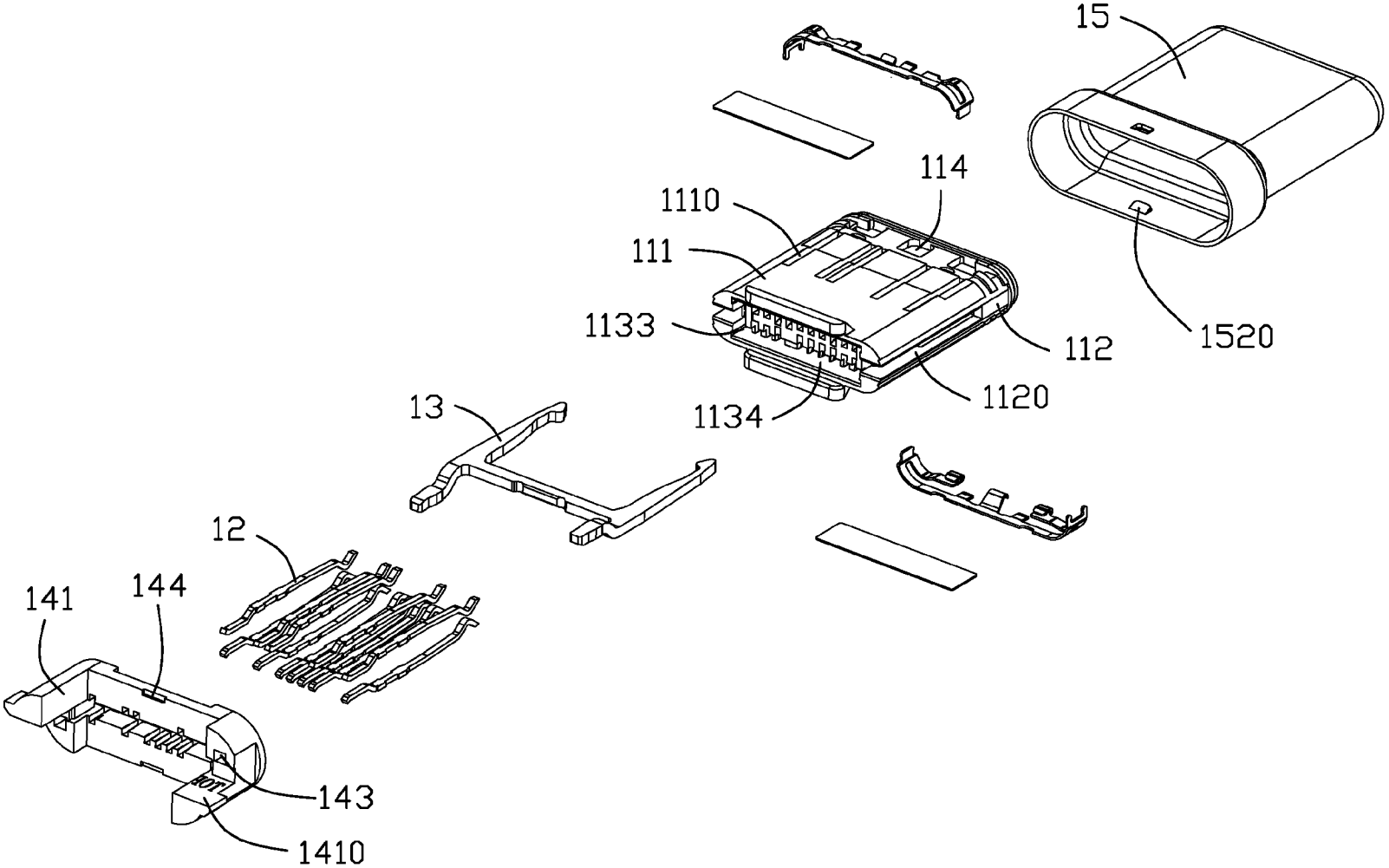
FIG. 9 is an exploded view similar to FIG. 8, but from a different aspect.

Referring to FIGS. 8 and 9, the mating member 1 comprises an insulative housing 11, a plurality of contacts 12 arranged in two rows and spaced apart from each other in a vertical direction, a latch 13 disposed between the two rows of contacts 12 for latching with the mating connector, an insulative member 14 assembled on a rear end of the insulative housing 11, a mating shell 15 covering the insulative housing 11 and the insulative member 14, and a grounding member 16 assembled on the insulative housing 11 and electrically connected to the mating shell 15.

The insulative housing 11 comprises a top wall 110, a bottom wall 111 spaced apart from and parallel with the top wall 110 in a vertical direction, a pair of side walls 112 parallel to each other and connecting with top wall 110 and the bottom wall 111, a receiving room 113 surround by the top, bottom, and side walls 110, 111, 112, and the receiving room 113 is divided into a front portion 1132 having a front opening 1131 and a rear portion 1134 having a rear opening 1133. The top wall 110 defines a top recess 1100 in communication with the front portion 1132. The bottom wall 111 defines a bottom recess 1110 in communication with the front portion 1132. Each of the side walls 112 defines a side recess 1120 extending forwardly from a rear end of the insulative housing 11 but not through a front end of the insulative housing 11. The side recesses 1120 are in communication with the front portion 1132 and the rear portion 1134 of the receiving room 113. A plurality of slots 114 are defined on a front end of the both top wall and the bottom wall 111.

Each of the contacts 12 comprises, along a front-to-back direction, a front mating portion 121 extending forwardly into the insulative housing 11, a rear mating/mounting portion 122 extending rearwardly, and an intermediate mounting portion 123 connected between the front mating portion 121 and the rear mating portion 122 and secured to the insulative housing 11. The front mating portion 121 is to be mated with the mating connector and the rear mating portion 122 is to be electrically mated with the printed circuit board 2. The front mating portions 121 of the two rows of contacts 12 are arranged face to face along a vertical direction.

The latch 13 comprises a base portion 131 extending along a transverse direction, a pair of latch beams 132 respectively extending forwardly from two opposite ends of the base portion 131, a latch portion 133 extending from a front end of each latch beam 132 along a face to face direction, and a pair of extension arms 134 respectively extending rearwardly from the two opposite ends of the base portion 131. An extension arm 134 on one side is in a lower plane relative to a plane the base portion 131 located, and another extension arm 134 on another side is in a higher plane relative to the plane the base portion 131 located. The latch 13 is mounted into the insulative housing 11 through the rear opening 1133 of the rear portion 1134 of the receiving room 113 along a rear-to-front direction. The latch beams 132 are received into the side recesses 1120, respectively. At least a portion of the latch portions 133 projects into the front portion 1132 of the receiving room 113. The latch portions 133 are arranged face to face along the left-to-right direction.

The insulative member 14 together with the insulative housing 11 fix the latch 13. The insulative member 14 includes a base portion 140 made of insulative material, a pair of extension portions 141 rearwardly extending from a rear end of the base portion 140. The base portion 140 defines a plurality of through holes 142 therethrough along a front-to-rear direction and arranged in two rows apart from each other along the vertical direction, to pass through the corresponding contacts 12, and a pair of mounting holes 143 defined on the opposites sides of the base portion 140 to pass through the extension arms 134. Each of the extension portions 141 defines an outward protruding sheet 1410 thereon. The dimension of the base portion 140 along the vertical direction is greater than the dimension of the insulative housing 11, thus when the insulative member 14 is mounted on the insulative housing, the insulative member 14 is exposed to the top wall 110 and bottom wall 111 of the insulative housing 11 along the vertical direction. The insulative member 14 is mounted on the insulative housing 11 along a rear-to-front direction, the extension arms 134 extending into the mounting holes 143, the rear mating portions 122 of the contacts 12 passing through the through holes 142. The base portion 140 defines a stuck slot 144.

The mating shell 15 has a closed circumference that has a good seal performance, a good anti-EMI performance, etc. The closed circumference of the mating shell 15 could be manufactured by drawing a metal piece, bending a metal piece, casting metal materials, etc. The mating shell 15 comprises a first front end 151 for being inserted into the mating connector, a first rear end 152 with a larger size than the first front end 151, and a first transition portion 153 for connecting to the first front end 151 and the first rear end 152. The shape of the first rear end 152 is consistent with the insulative member 14. A diametrical dimension of the first front end 151 is smaller than a diametrical dimension of the first rear end 152. The first rear end 152 comprises a pair of latch tabs 1520 projecting outwardly to engage with the stuck slot 144 of the insulative member 14.

The grounding members 16 is a pair, and mounted on the top wall 110 and the bottom wall 111 of the insulative housing 11 respectively. Each of the grounding members 16 includes a main body 160, a pair of resilient sheets 161 extending towards to the insulative housing 11 from the main body 160 and a grounding sheet 162 forwardly extending from a front end of the main body 160 to be received in the first front portion 1132 of the receiving room 113. The resilient sheets 161 and grounding sheet 162 are received in the corresponding slots 114 of the insulative housing 11 respectively. The grounding sheets 162 are to mat with the mating connector. The pair of grounding sheets 162 of the pair of grounding members 16 is arranged face to face along the vertical direction. The direction between the pair of grounding sheets 162 is greater than the direction between the front mating portions 121 of the upper row of contacts 12 and the front mating portions 121 of the lower row of contacts 12 along the vertical direction.

Referring to FIGS. 4 to 7, the printed circuit board 2 is disposed between the mating member 1 and the cable 300, the cable 300 is electrically connected to the contacts 12 via the printed circuit board 2. The printed circuit board 2 includes a front end 21, a rear end 22 disposed on a rear end thereof and a middle portion 23 between the front end 21 and the rear end 22. The printed circuit board 2 includes a top surface 24 and an opposite bottom surface 25. A plurality of first conductive pads 210 are defined on both of the top and bottom surface 24, 25 of the front end 21, to be connected to the corresponding rear mating portions 122 of the contacts 12. A plurality of second conductive pads (not shown) are defined on the top surface 24 of the rear end 22, to be connected to the cable 300 electrically. The dimension of the front end 21 is smaller than the dimension of the rear end 22 of the printed circuit board 2. The light emitting elements 4 is mounted on the middle portion 23. Both of the top surface 24 and the bottom surface 25 have a pair of light emitting elements 4. The pair of light emitting elements 4 on the top surface 24 is symmetrical with the pair of light emitting elements 4 on the bottom surface 25. Each of the top surface 24 and the bottom surface 25 of the middle portion 23 defines a metal sheet 26, to be soldered on the corresponding extension arms 134 of the latch 13, for strengthening the fixation of the latch 13. The front end 21 is disposed between the rear mating portions 122 of the upper row of contacts 12 and the rear mating portions 122 of the bottom row of contacts 12. The rear mating portions 122 are connected with the corresponding first conductive pads 210 electrically. The portions of the printed circuit board 2, which the light emitting element 4 mounted in, are inwardly recessed to form a depression portion 27 thereon. The depression portions 27 make the light emitted by the corresponding light emitting element 4 be uniformly revealed from the electrical connector 200. The depression portion 27 is U-shaped. An outer side face 42 of the light emitting element 4 is aligned with an innermost side surface 272 of the U-shaped depression portion 27.

The cable 300 has a number of wires 30 and a sheath 31 that contains the wires 30.

In present embodiment, the light emitting elements 4 are LEDs.

The fixing member 5 includes a main body 51, a pair of fixing portions 52 forwardly extending along an inserting direction from the both sides of the main body 5 respectively. The pair of fixing portion 52 caught the rear end 22 of the printed circuit board 2. The main body 51 of the fixing member 5 defines a plurality of through holes 511 through a front surface and a rear surface of the main body 51, for the wires 30 of the cable 300 to through.

Figure 4:
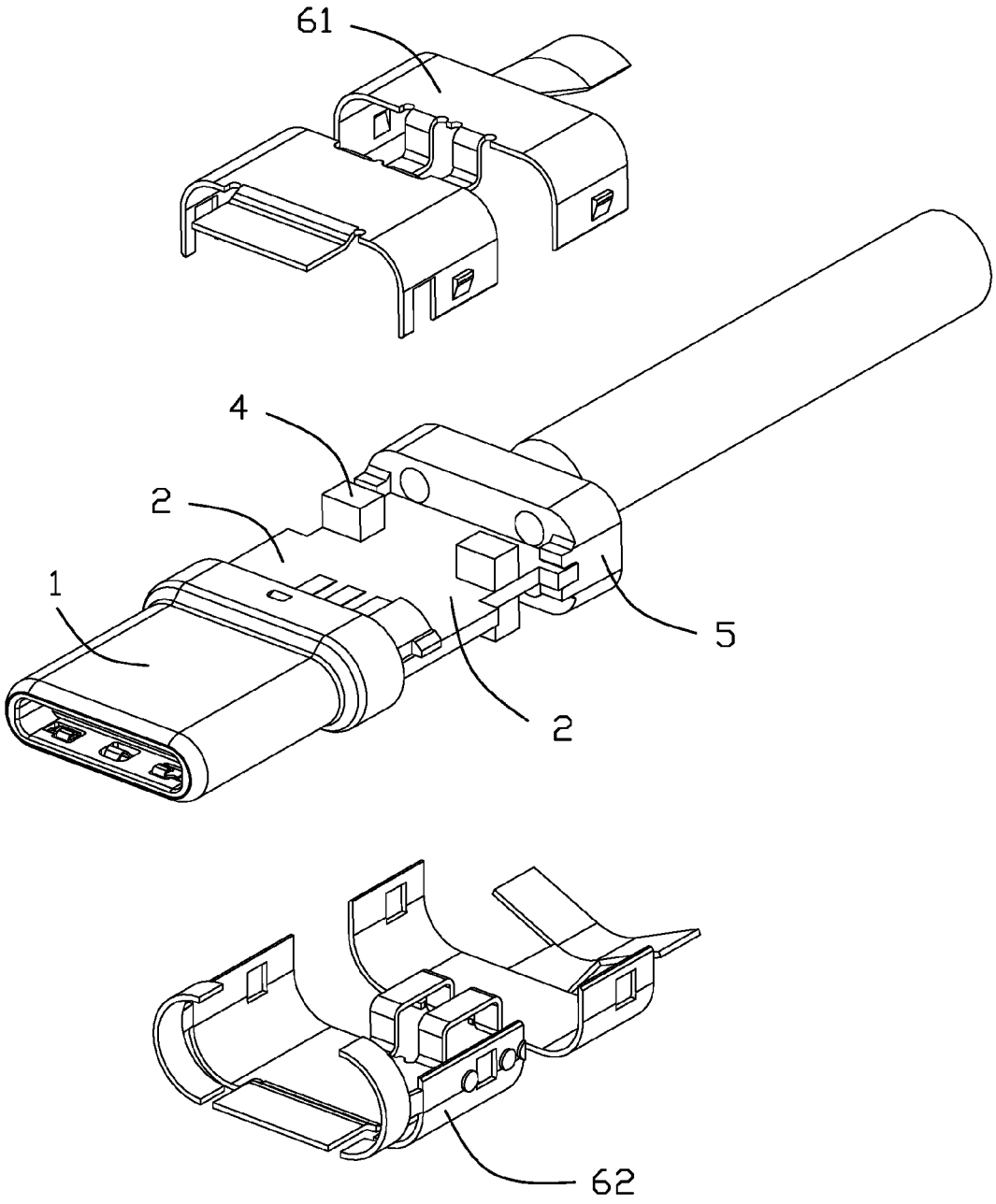
FIG. 4 is a further partially exploded view of the cable connector assembly in FIG. 3.
Figure 5:
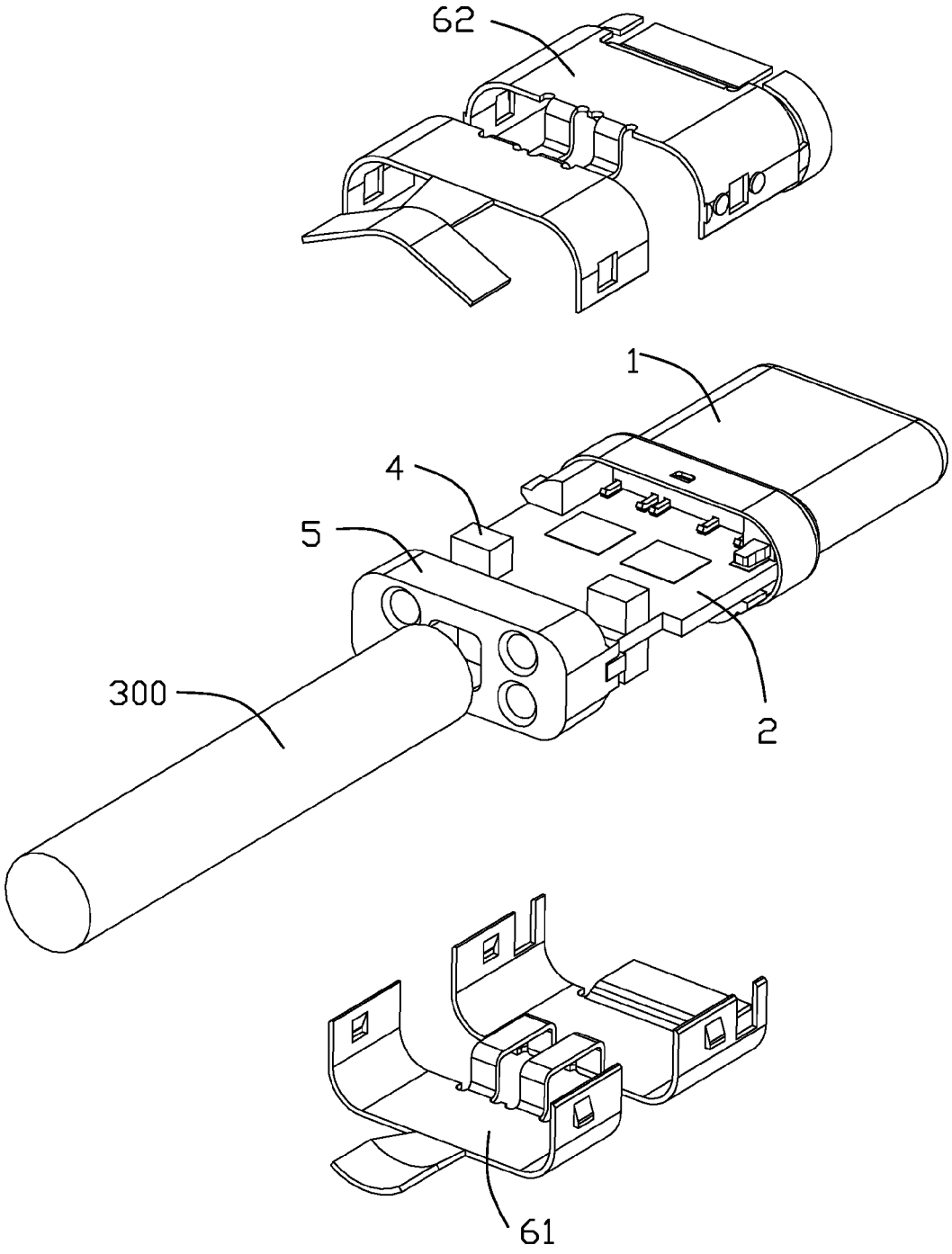
FIG. 5 is a partially exploded view similar to the FIG. 4, but from a different aspect.
Figure 6:
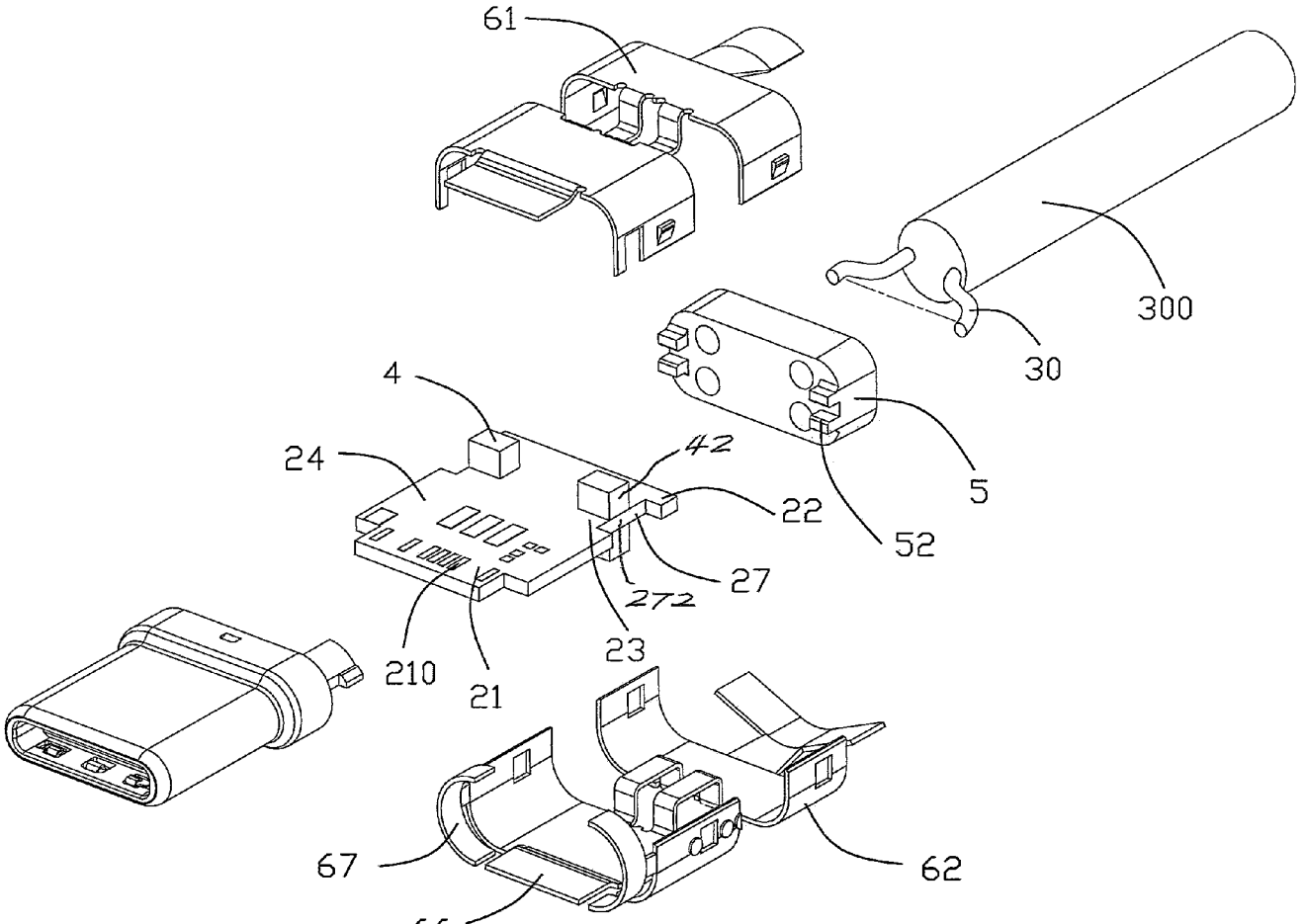
FIG. 6 is an exploded view of the cable connector assembly in FIG. 1.
Figure 7:
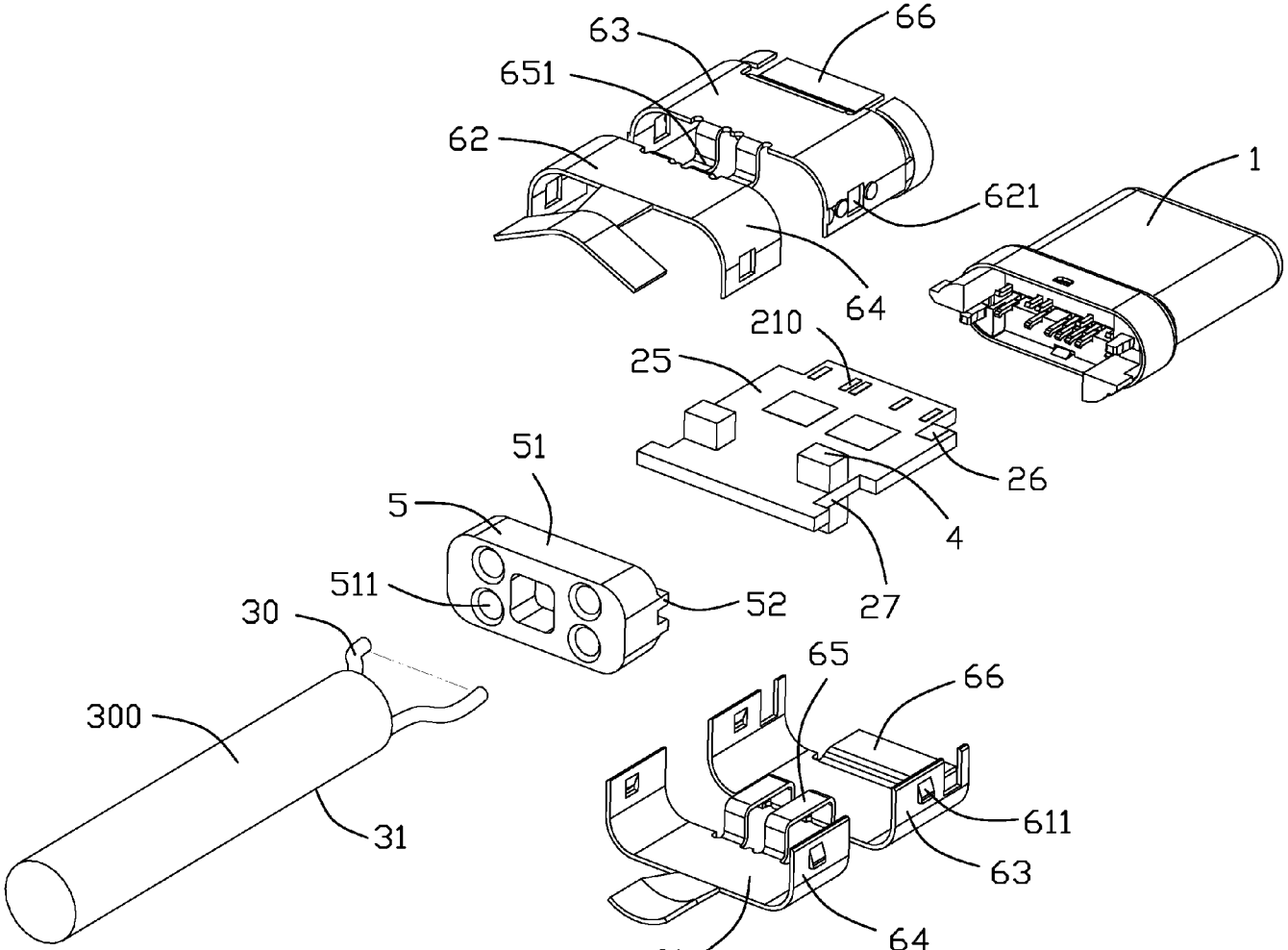
FIG. 7 is an exploded view similar to FIG. 6, but from a different aspect.
Figure 10:
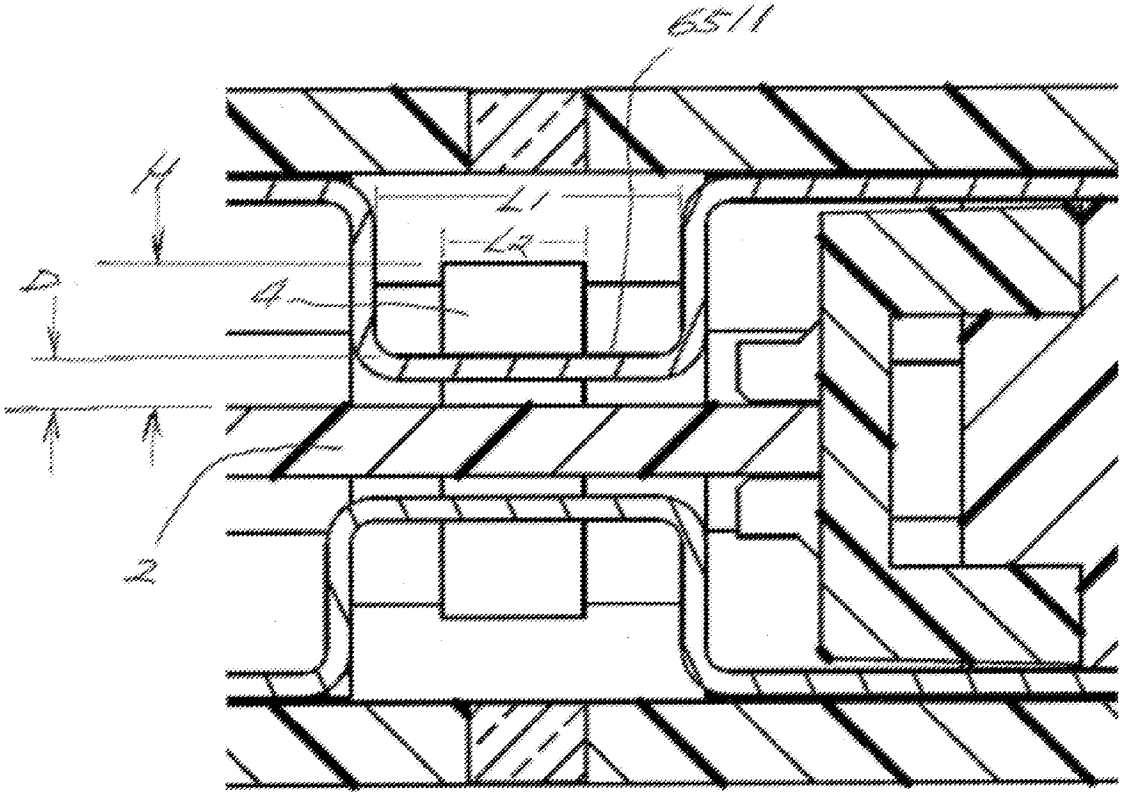
FIG. 10 is an enlarged, partial sectional view of the cable connector assembly in FIG. 1.

Referring particularly to FIGS. 4 and 5, the metal shell 6 includes a first shell 61 and a second shell 62 engaged with the first shell 61. Both of the first shell 61 and the second shell 62 include a front portion 63 close to the mating member 1, a rear portion 64 close to the cable 300 and a connecting portion 65 for connecting the front portion 63 and the rear portion 64 wherein an axial gap (not labeled) is formed between the front portion 63 and the rear portion 64 in the front-to-back direction. Each of the first shell 61 and the second shell 62 includes a tongue sheet 66 extending from a front end of the front portion 63. The pair of tongue sheets 66 is soldered on the first rear end 152 to be further fixed. The pair of tongue sheets 66 accordance with other embodiment can be fixed on the first rear end 152 using glue or other method. In the present embodiment, the second shell 62 defines a pair of holding portions 67 on the both sides of the tongue sheet 66, to hold the first rear end 152. The holding portions 67 are further fixed on the first rear end 152 by soldering or other method. The connecting portion 65 is disposed between the pair of light emitting elements 4. That is, when a single light emitting element is considered, the connecting portion 65 is located beside either light emitting element in a transverse direction. The connecting portion 65 is, viewed along the transverse direction, a groove structure 651 connecting with the front portion 63 and rear portion 64 and inwardly recessed toward the printed circuit board 2. The distance D between the bottom surface 6511 of the groove 651 and a planar surface of the printed circuit board 2 is smaller than the height H of the light emitting element 4 or equal to the height H of the light emitting element 4, as shown in FIG. 10, thus the connecting portion 65 does not obstruct the light emitted from the top surface of the light emitting element 4, and can eliminate shadow and achieve a better light effect. It other words, the groove structure 651 allows light emitted from the light emitting element 4 to efficiently spread above the groove structure for transmitting the light toward the light transmissive region 81 without blocking. The length L1 of the connecting portion 65 along the inserting direction is greater than the length L2 of the light emitting element 4 along the inserting direction, or equal to the length L2 of the light emitting element 4, as shown in FIG. 10. In this embodiment, along the transverse direction the dimension of the connecting portion is not more than one half of the dimension of the printed circuit board 2 so as to provide sufficient exposed portions in the gap. The both sides of the first shell 61 define a fixing elastic sheet 611. The both sides of the second shell 612 define a holding through hole 621 for fixing the corresponding fixing elastic sheet 611 therein. The fixing elastic sheets 611 are fixed in the corresponding holding through holes 621 to fix the first shell 61 with the second shell 62.

The outer case 8 is formed on the metal case 6 and a part of the cable 300. The outer case 8 defines a light-transmissive region 81, which functions as a light waveguide, radially corresponding to the axial gap between the front portion 63 and the rear portion 64 to face the connecting portion 65 and two opaque regions 82 disposed on two sides of the light-transmissive region 81. The light emitted by the light emitting element 4 passes through the light-transmissive region 81 to form a continuous aperture. The opaque regions 82 are set to dark, such as black, to achieve a better shading effect.

In assembling the cable connector assembly 100, firstly, the mating member 1 and printed circuit board 2 are provided. The light emitting elements 4 are mounted on the top and bottom surface 24, 25 of the printed circuit board 2. The printed circuit board 2 is inserted into the rear end of the mating member 1. The extension arms 134 of the latch 13 are soldered on the corresponding metal sheets 26 of the printed circuit board 2. The cable 300 is further provided. The wires 30 of the cable 300 are soldered on the corresponding second conductive pads (not shown) on the rear end 22 of the printed circuit board 2. The metal shell 6 is engaged along a top-to-bottom direction to enclose the printed circuit board 2, exposing the light emitting element 4. The first shell 61 is fixed with the second shell 62 by the engagement of the fixing elastic sheets 611 and the corresponding holding holes 621. The holding portion 67 and the tongue sheet 65 are soldered on the first rear end 152 respectively. The strain relief 7 is molded on a part of the metal shell 6. The outer case 8 is mounted on a front end of the metal shell 6 and the strain relief 7 along a front-to-rear direction. The outer case 8 is fixed by glue or other method. Thus, the cable connector assembly 100 is completed. The order of assembly of the cable connector assembly 100 is not unique, art can make adaptation according to installation requirements.

What is claimed is:

1. A cable connector assembly comprising:

a printed circuit board defining two opposite surfaces in a vertical direction;

a mating member electrically and mechanically connected to a front region of the printed circuit board along a front-to-back direction perpendicular to said vertical direction;

a cable enclosing a plurality of wires mechanically and electrically connected to a rear region of the printed circuit board along said front-to-back direction;

a pair of light emitting elements mounted upon one of said two opposite surfaces;

a metallic shell circumferentially enclosing said printed circuit board and including a front portion and a rear portion connected with each other by a middle connecting portion which is essentially located in a gap between said front portion and said rear portion in said front-to-back direction; and an insulative outer case enclosing the metallic shell with a ring type light transmissive region aligned with the gap in the vertical direction; wherein the connecting portion is disposed between the pair of light emitting elements in a transverse direction perpendicular to both said vertical direction and said front-to-back direction, and further defines a groove structure inwardly recessed toward the printed circuit board so as to allow light emitted from the light emitting element toward the light transmissive region without blocking by said connecting portion.

2. The cable connector assembly as claimed in claim 1, wherein along the front-to-back direction, the gap defines a dimension which is larger than another dimension defined by the light emitting element.

3. The cable connector assembly as claimed in claim 1, wherein along the transverse direction, a dimension of said connecting portion is not more than one half of a dimension of the printed circuit board.

4. The cable connector assembly as claimed in claim 1, wherein a bottom of the groove structure is close to but not contacting said one of the two opposite surfaces of the printed circuit board.

5. The cable connector assembly as claimed in claim 1, wherein the printed circuit board defines a depression portion in a lateral side edge thereof, and the light emitting element is located beside said depression portion.

6. A cable connector assembly comprising:

a printed circuit board defining two opposite surfaces in a vertical direction;

a mating member electrically and mechanically connected to a front region of the printed circuit board along a front-to-back direction perpendicular to said vertical direction;

a cable enclosing a plurality of wires mechanically and electrically connected to a rear region of the printed circuit board along said front-to-back direction;

at least one light emitting element mounted upon one of said two opposite surfaces;

a metallic shell circumferentially enclosing said printed circuit board and including a front portion and a rear portion connected with each other by a middle connecting portion which is essentially located in an axial gap between said front portion and said rear portion in said front-to-back direction, the connecting portion being located beside the at least one light emitting element; and an insulative outer case enclosing the metallic shell with a ring type light transmissive region aligned with the axial gap in the vertical direction; wherein said connecting portion is inwardly recessed toward the printed circuit board while outwardly confronting said ring type light transmissive region for maximizing light transmission from the at least one light emitting element toward the ring type light transmissive region.

7. The cable connector assembly as claimed in claim 6, wherein said connecting portion forms a groove structure.

8. The cable connector assembly as claimed in claim 7, wherein a bottom of said groove structure is not higher than a top face of the light emitting element.

9. The cable connector assembly as claimed in claim 8, wherein the bottom of the groove structure does not touch said one of the two opposite surfaces of the printed circuit board.

* * * * *